US012383785B2

(12) United States Patent
Olson et al.

(10) Patent No.: US 12,383,785 B2
(45) Date of Patent: Aug. 12, 2025

(54) EXERCISE DEVICE TARGETING ANTERIOR TIBIALIS MUSCLES AND METHOD OF USE

(71) Applicants: Gregory Scott Olson, Owatonna, MN (US); Zachary Scott Olson, Owatonna, MN (US); Clarence Louis Boyd, Blooming Prairie, MN (US)

(72) Inventors: Gregory Scott Olson, Owatonna, MN (US); Zachary Scott Olson, Owatonna, MN (US); Clarence Louis Boyd, Blooming Prairie, MN (US)

( * ) Notice: Subject to any disclaimer, the term of this patent is extended or adjusted under 35 U.S.C. 154(b) by 159 days.

(21) Appl. No.: 18/238,213

(22) Filed: Aug. 25, 2023

(65) Prior Publication Data

US 2025/0065178 A1 Feb. 27, 2025

(51) Int. Cl.
*A63B 21/00* (2006.01)
*A63B 21/065* (2006.01)
(Continued)

(52) U.S. Cl.
CPC ..... *A63B 21/4015* (2015.10); *A63B 21/065* (2013.01); *A63B 21/0728* (2013.01); *A63B 23/03525* (2013.01); *A63B 23/08* (2013.01)

(58) Field of Classification Search
CPC ..... A63B 21/4015; A63B 21/065; A63B 21/0728; A63B 21/0004; A63B 21/06;
(Continued)

(56) References Cited

U.S. PATENT DOCUMENTS 5,722,919 A * 3/1998 Timmer ..... A63B 23/08 482/79
6,238,325 B1 * 5/2001 Oxford ..... A63B 21/0004 482/79

(Continued)

FOREIGN PATENT DOCUMENTS

CN 109621317 A * 4/2019
GB 2414420 A * 11/2005 ..... A63B 21/0628
NL 1025935 C2 * 10/2005 ..... A63B 21/072

OTHER PUBLICATIONS

Tib Bar Bros, "Tib Bar—Tibialis Trainer—Free Weight Clip," retrieved from internet on Mar. 27, 2025, date of first review Jul. 11, 2022, <https://tib-bar.com/products/tib-bar> (Year: 2022).*

*Primary Examiner* — Loan B Jimenez
*Assistant Examiner* — Kathleen M Fisk

(57) ABSTRACT

An exercise device targeting anterior tibialis muscles which specifically targets anterior tibialis muscles includes weight engagement, sliding, and locking elements. The weight engagement element comprises a dorsum bar, which is attached to and which extends bidirectionally from a first end of a weight bar. The sliding element comprises a heel bar, which is attached to and which extends bidirectionally from a first terminus of an extension bar. A second terminus of the extension bar is slidable along and releasably securable to the weight bar so that the dorsum bar and the heel bar can be fit to feet of a user. The weight bar is insertable through the central hole of one or more weights so that the one or more weights abut the extension bar. The locking
(Continued)

element is slidable along and releasably securable to the weight bar to retain the one or more weights in position.

6 Claims, 12 Drawing Sheets

(51) Int. Cl.
*A63B 21/072* (2006.01)
*A63B 23/035* (2006.01)
*A63B 23/08* (2006.01)

(58) Field of Classification Search
CPC ..... A63B 21/072; A63B 21/4001; A63B 21/4013; A63B 21/4033; A63B 21/4034; A63B 23/03525; A63B 23/08; A63B 23/085; A63B 23/10; A63B 23/0494
See application file for complete search history.

(56) References Cited

U.S. PATENT DOCUMENTS 6,485,399 B2 * 11/2002 Greene ..... A63B 21/4015 482/106
6,592,497 B2 * 7/2003 Greenheck ..... A63B 23/0494 482/79
6,699,162 B2 * 3/2004 Chen ..... A63B 21/4015 482/907
7,097,601 B1 * 8/2006 Ronnow ..... A63B 21/072 482/106
7,137,930 B1 * 11/2006 Carr ..... A63B 21/072 482/50
10,583,323 B2 * 3/2020 Little ..... A63B 21/4015
10,881,895 B2 * 1/2021 Gubera ..... A63B 23/04
11,337,879 B2 * 5/2022 Shuch ..... A61H 9/0092
11,623,115 B1 * 4/2023 Fleischman ..... A63B 21/00065 482/93
2007/0275833 A1 * 11/2007 Ramsey ..... A63B 21/0628 482/79
2015/0024909 A1 * 1/2015 Louviere ..... A63B 23/0216 482/139
2015/0335935 A1 * 11/2015 Peralo ..... A63B 21/012 482/93
2016/0256730 A1 * 9/2016 Bartos ..... A63B 21/072
2018/0133545 A1 * 5/2018 Marti ..... A63B 23/08
2023/0089120 A1 * 3/2023 Sears ..... A63B 21/4034 482/79
2023/0381571 A1 * 11/2023 Sasano ..... A63B 23/10

* cited by examiner

EXERCISE DEVICE TARGETING ANTERIOR TIBIALIS MUSCLES AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise devices and more particularly pertains to a new exercise device which specifically targets anterior tibialis muscles. The anterior tibialis muscles are particularly difficult to engage using exercise devices commonly used found in gyms. Thus, exercise devices specifically targeting the anterior tibialis muscles are required.

(2) Description of Related Art Including Information Disclosed Under 37 CFR 1.97 and 1.98

The prior art relates to exercise devices targeting anterior tibialis muscles but which do not have a feet engagement means that is adjustable to the feet of users having feet of a variety of sizes.

BRIEF SUMMARY OF THE INVENTION

An embodiment of the disclosure meets the needs presented above by generally comprising a weight engagement element, a sliding element, and a locking element. The weight engagement element comprises a dorsum bar, which is attached to and which extends bidirectionally from a first end of a weight bar. The sliding element comprises a heel bar, which is attached to and which extends bidirectionally from a first terminus of an extension bar. A second terminus of the extension bar is slidable along and is releasably securable to the weight bar at a user selectable position wherein the extension bar extends away from the weight bar. The dorsum bar and the heel bar thus are positioned so as to fit feet of a user. The locking element is configured to retain one or more weights on the weight bar. The locking element is slidable along and is releasably securable to the weight bar. The weight bar is configured for insertion through a central hole of the one or more weights so that the one or more weights abut the extension bar. The user then can slide back on a seat so that legs of the user are straightened and supported and enable the user to perform alternating dorsiflexion movements and plantarflexion movements of the feet to exercise their anterior tibialis muscles.

Another embodiment of the disclosure includes an exercise system targeting anterior tibialis muscles, which comprises the exercise device, as per the disclosure above. The second terminus of the extension bar has been slid along the weight bar to position the dorsum bar and the heel bar to fit feet of a user and has been releasably secured to the weight bar. The weight bar has been inserted through the central hole of one or more weights, which abut the extension bar and which are retained in position by the locking element.

Yet another embodiment of the disclosure includes a method of exercising anterior tibialis muscles, which comprises providing the exercise system, as described above. Steps of the method include positioning the exercise system on a surface in front of a seat, assuming a seated position upon the seat, positioning one's heels upon the heel bar such that the dorsa of one's feet are positioned under the dorsum bar, sliding back upon the seat so that one's legs are straightened and are supported by the seat, and performing alternating dorsiflexion movements and plantarflexion movements of the feet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
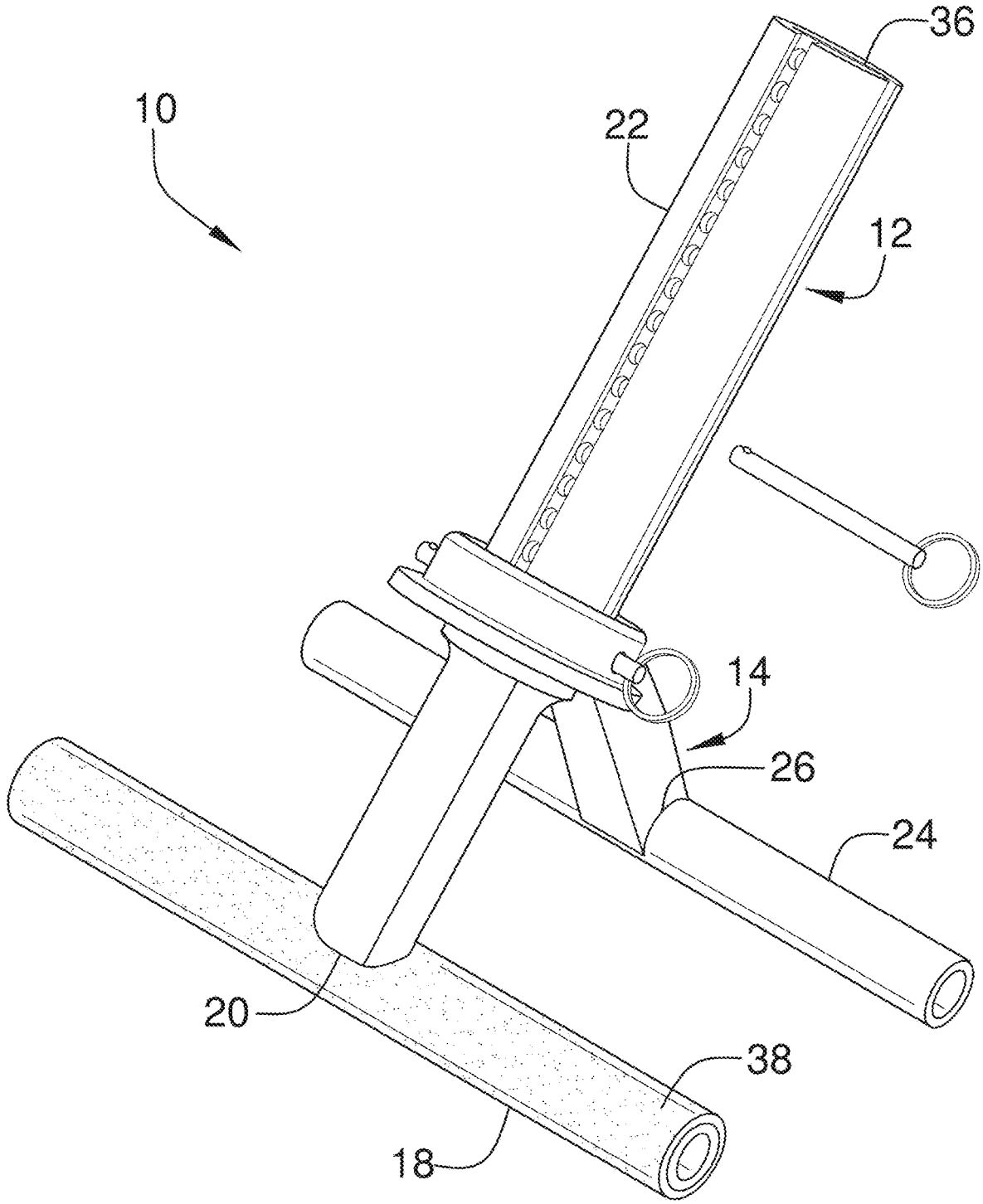
FIG. 1 is a front isometric perspective view of an exercise device targeting anterior tibialis muscles according to an embodiment of the disclosure.

With reference now to the drawings, and in particular to FIGS. 1 through 12 thereof, a new exercise device embodying the principles and concepts of an embodiment of the disclosure and generally designated by the reference numeral 10 will be described.

Figure 2:
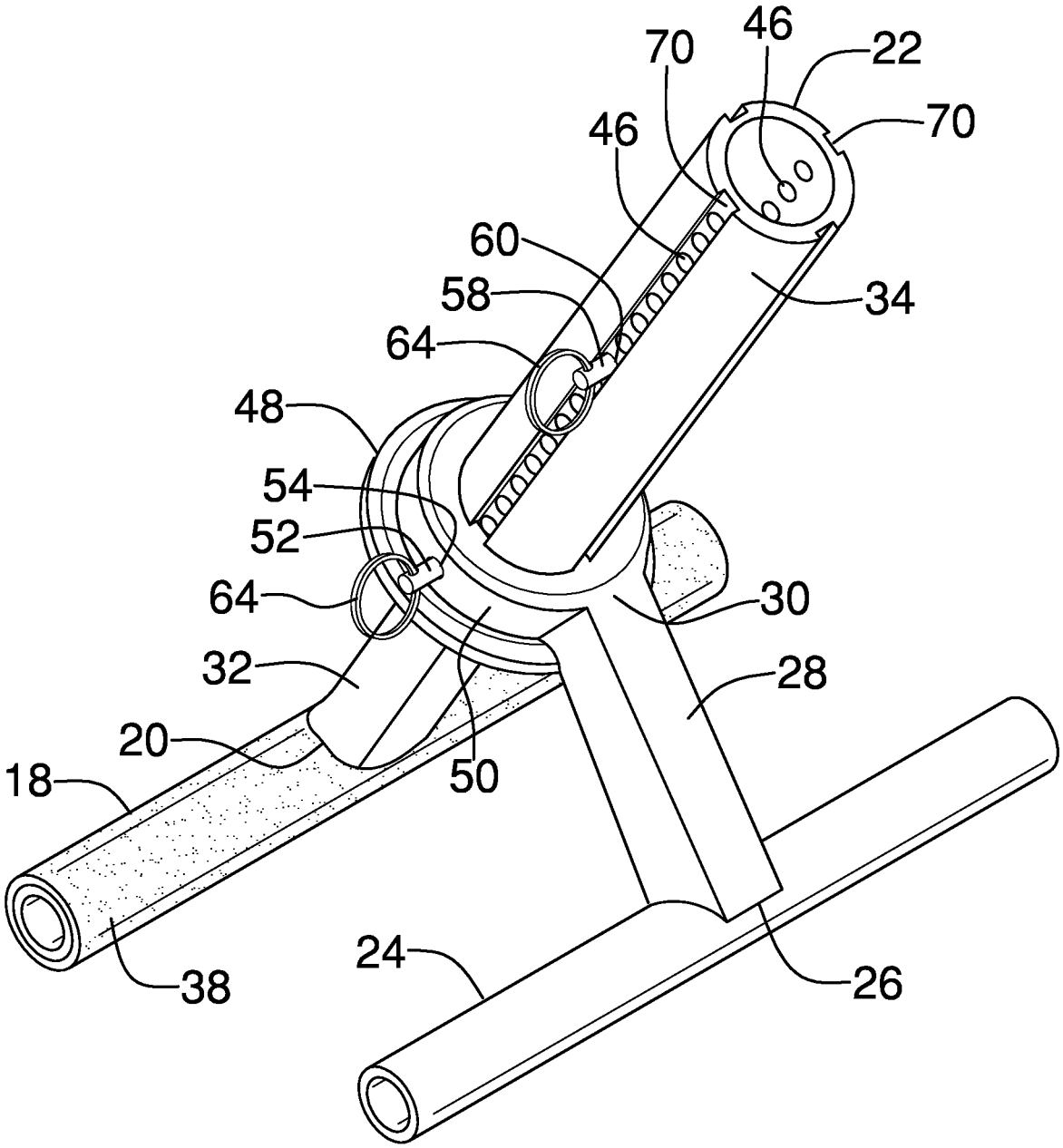
FIG. 2 is a rear isometric perspective view of an embodiment of the disclosure.
Figure 3:
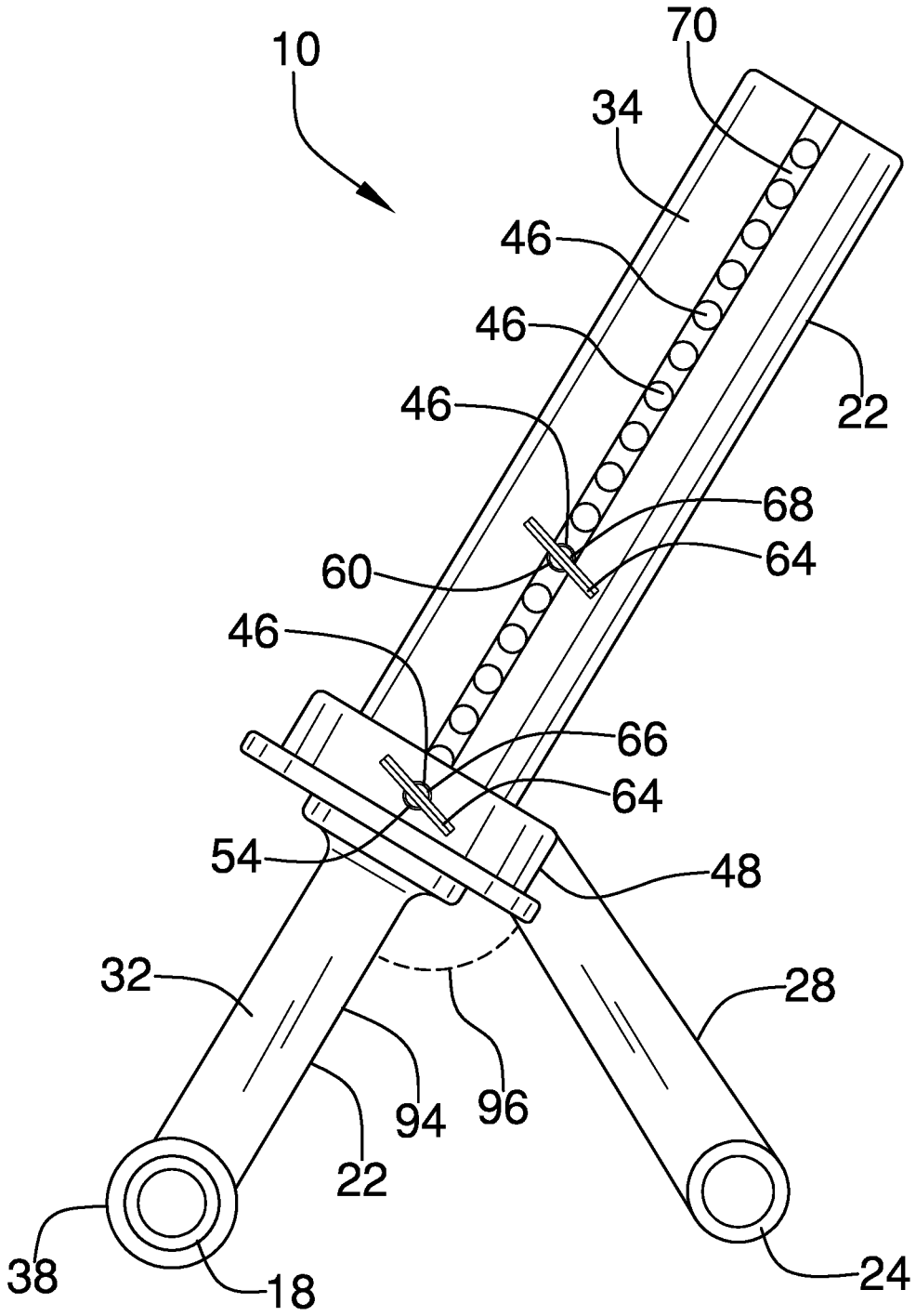
FIG. 3 is a side view of an embodiment of the disclosure.
Figure 4:
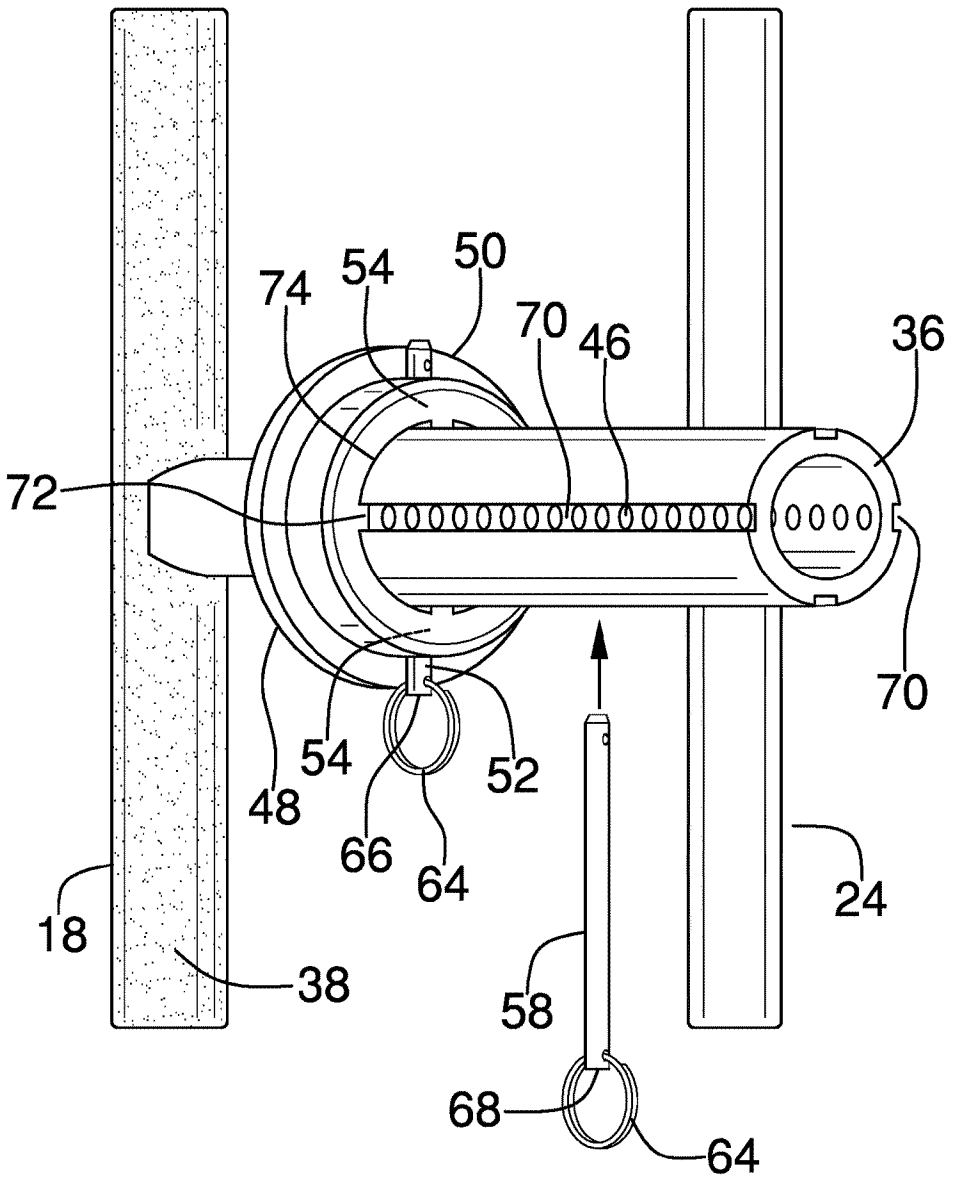
FIG. 4 is a top view of an embodiment of the disclosure.

As best illustrated in FIGS. 1 through 12, the exercise device 10 targeting anterior tibialis muscles generally comprises a weight engagement element 12, a sliding element 14, and a locking element 16. The weight engagement element 12 comprises a dorsum bar 18, which is attached to and which extends bidirectionally from a first end 20 of a weight bar 22. The sliding element 14 comprises a heel bar 24 and an extension bar 28. The heel bar 24 is attached to and extends bidirectionally from a first terminus 26 of the extension bar 28. A second terminus 30 of the extension bar 28 is slidable along and is releasably securable to the weight bar 22, with the extension bar 28 extending away from the weight bar 22. The heel bar 24 thus is positionally adjustable relative to the dorsum bar 18 so that dorsum bar 18 and the heel bar 24 can be oriented so as to fit feet of a user. A portion 94 of the weight bar 22, from the sliding element 14 to the first end 20, and the extension bar 28 form an angle 96, as is shown in FIG. 3, of from 45° to 105°.

Figure 5:
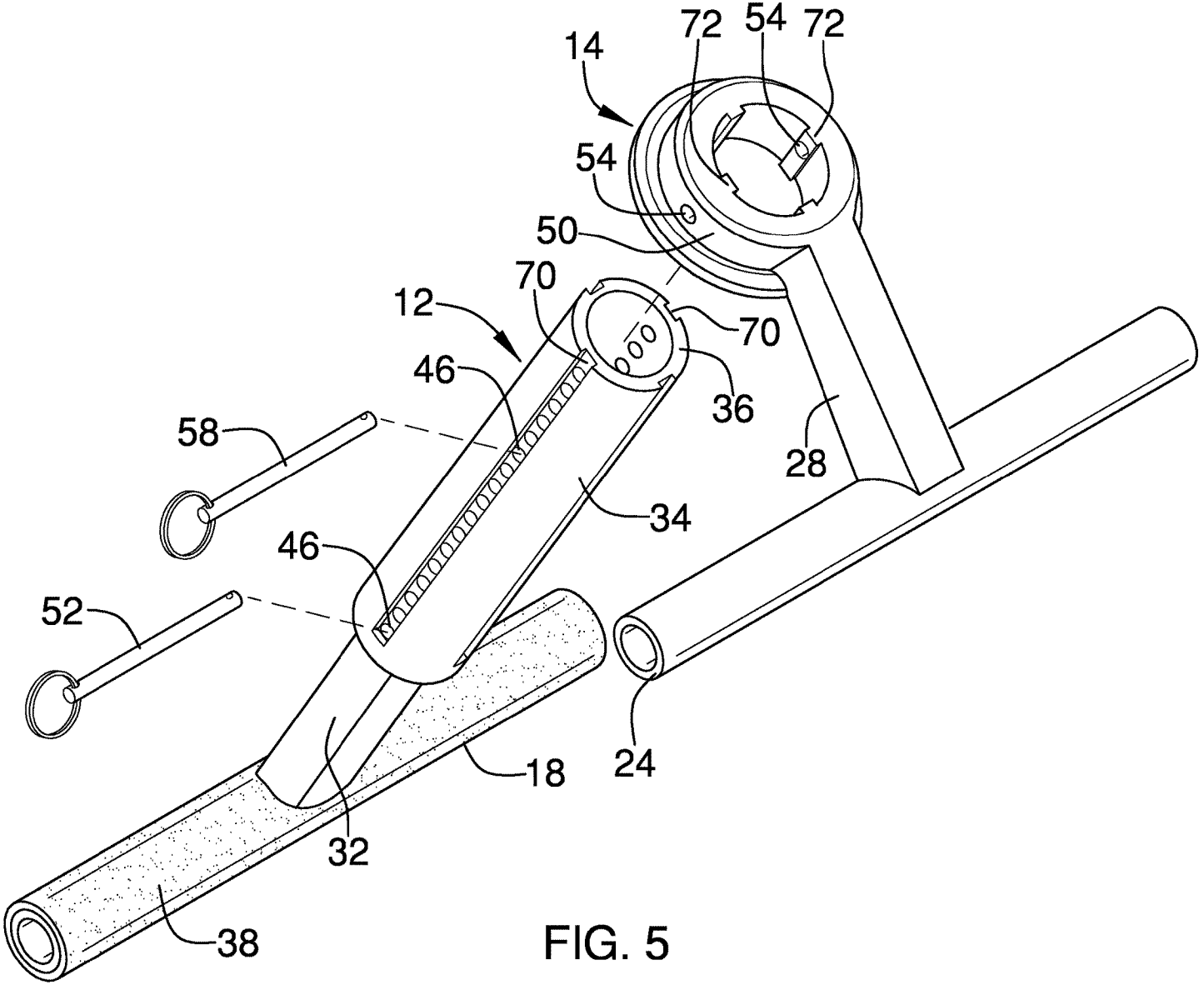
FIG. 5 is an exploded view of an embodiment of the disclosure.

The weight bar 22 comprises a first section 32, which extends from the first end 20, and a second section 34, which extends from a second end 36 of the weight bar 22. The first section 32 of the weight bar 22 and the extension bar 28 may be substantially rectangularly box shaped, as is shown in FIGS. 2 and 5, although the present invention also anticipates the first section 32 and the extension bar 28 being cylindrical, prismatic, hexagonal, or the like. Typically, as is shown in the figures, the second section 34 of the weight bar 22, the heel bar 24, and the dorsum bar 18 are cylindrical. The second section 34 of the weight bar 22, the heel bar 24, and the dorsum bar 18 may be hollow, as is shown in FIG. 2, or may be solid. The dorsum bar 18 typically would be padded with foamed elastomer, silicone, rubber, or the like. Padding 38 on the dorsum bar 18 may be rotatable around the dorsum bar 18 to facilitate movement of the feet relative to the dorsum bar 18 when the exercise device 10 is in use.

The weight engagement element 12 and the sliding element 14 are readily separable, thereby allowing for easy stowage and transport of the exercise device 10. The weight engagement element 12 and the sliding element 14 may comprise plastic or metal, such as steel, or the like. With the exercise device 10 comprising molded plastic, and in particular with the weight bar 22, the heel bar 24, and the dorsum bar 18 being hollow, the exercise device 10 would have a low mass, which would be advantageous for some users relative to the exercise device 10 comprising steel.

The locking element 16 is slidable along and releasably securable to the weight bar 22. The weight bar 22 is configured for insertion by its second end 36 through the central hole 40 of one or more weights 42 so that the one or more weights 42 abut the extension bar 28. The locking element 16 then can be slid along and releasably secured to the weight bar 22 to retain the one or more weights 42 in position on the weight bar 22. The user, upon being seated, can position their heels upon the heel bar 24 and the dorsa of their feet under the dorsum bar 18. The user then can slide back on the seat 44 so that their legs are straightened and supported, enabling the user to perform alternating dorsiflexion movements and plantarflexion movements of the feet to exercise their anterior tibialis muscles.

In one embodiment, as is shown in FIGS. 1 and 2, the weight bar 22 has a plurality of channels 46 extending axially therethrough. The sliding element 14 comprises a set ring 48, which is selectively positionable upon the weight bar 22 by insertion of the second end 36 of the weight bar 22 into the set ring 48. The extension bar 28 is attached to and extends away from an outer perimeter 50 of the set ring 48. A set pin 52 is selectively insertable through a respective channel 46 and a pair of set holes 54, the set holes 54 of which are opposingly positioned on the outer perimeter 50 of the set ring 48, so that the sliding element 14 is releasably secured to the weight engagement element 12.

Figure 6:
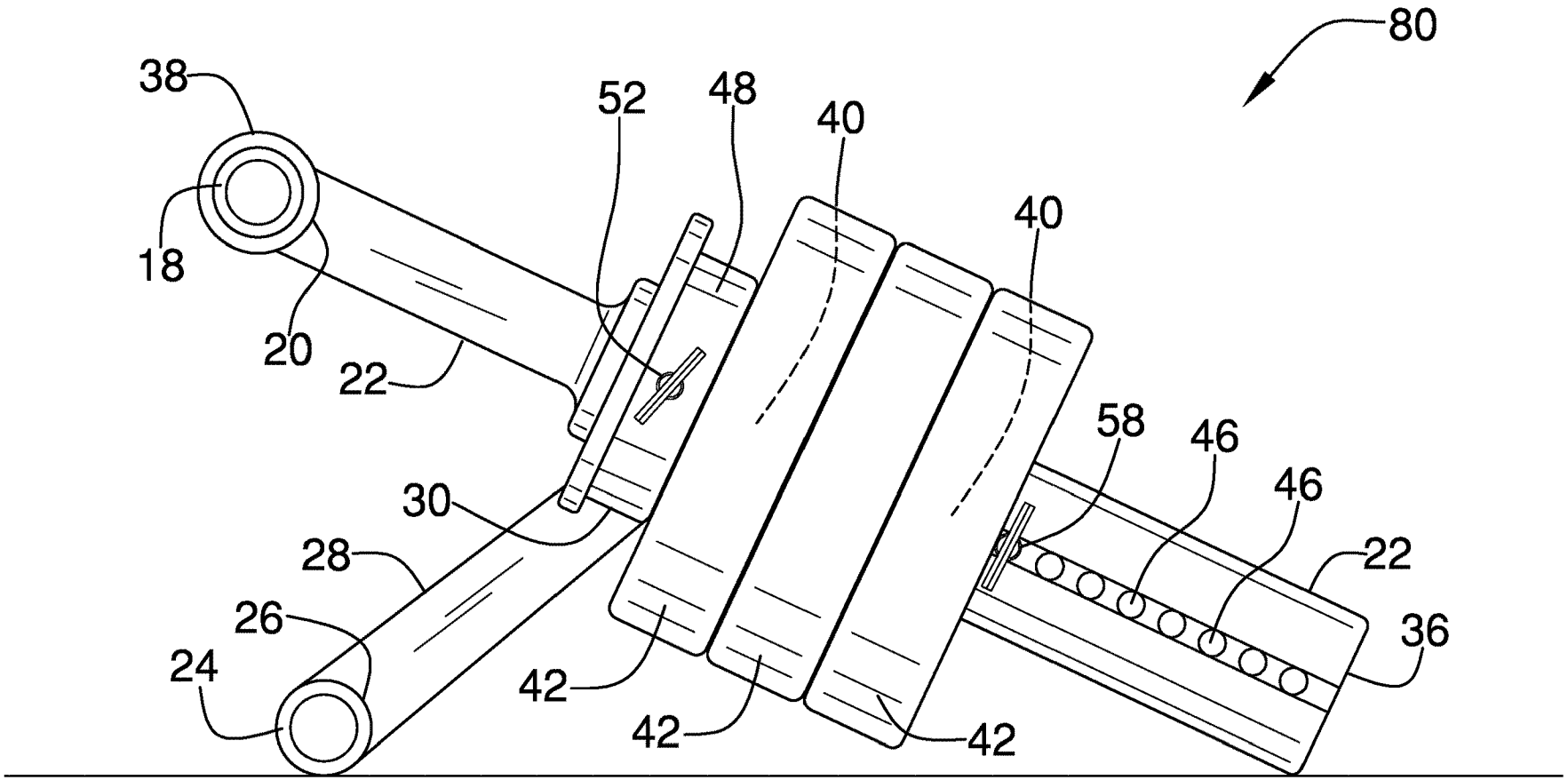
FIG. 6 is an in-use view of an embodiment of the disclosure.
Figure 7:
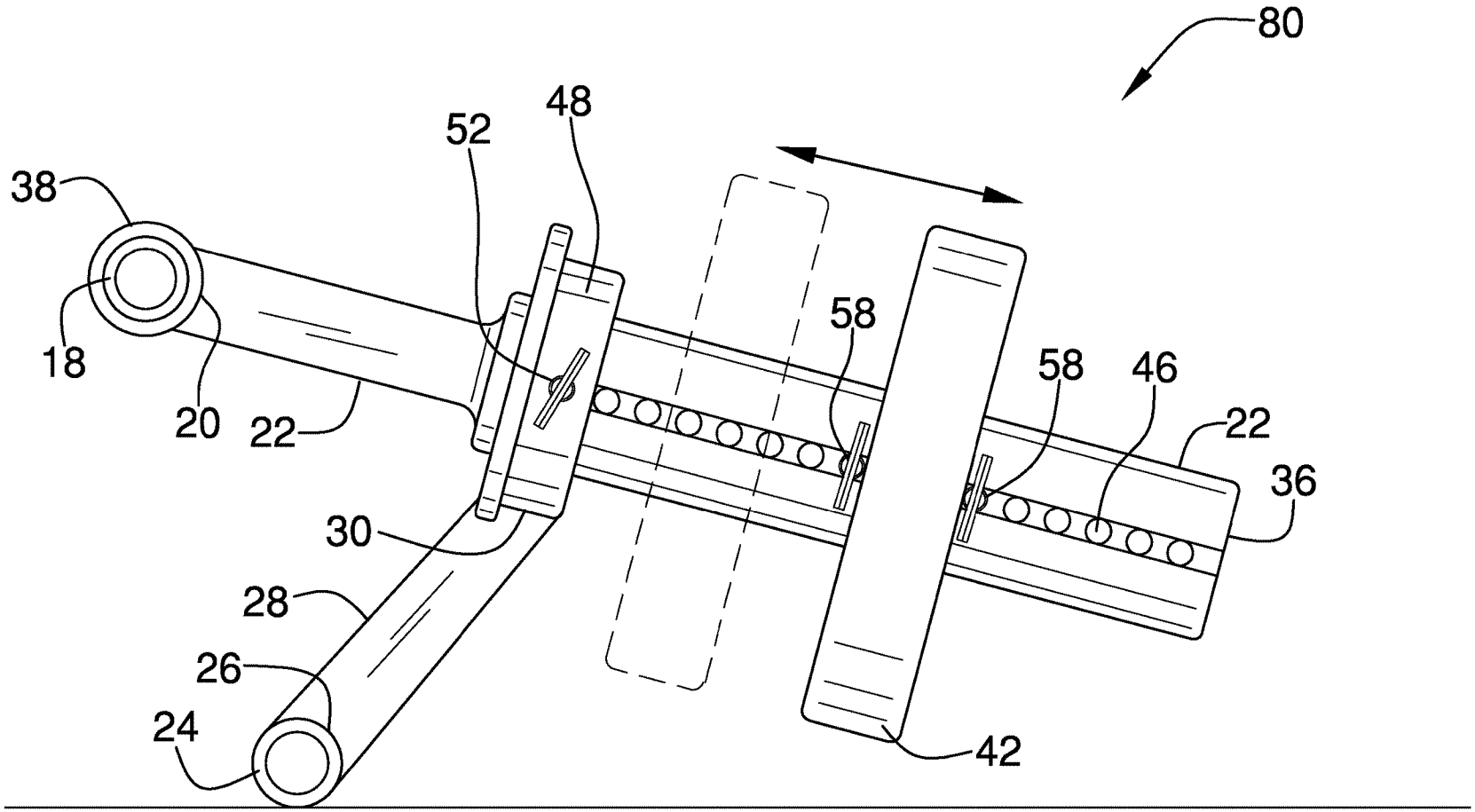
FIG. 7 is an in-use view of an embodiment of the disclosure.
Figure 10:
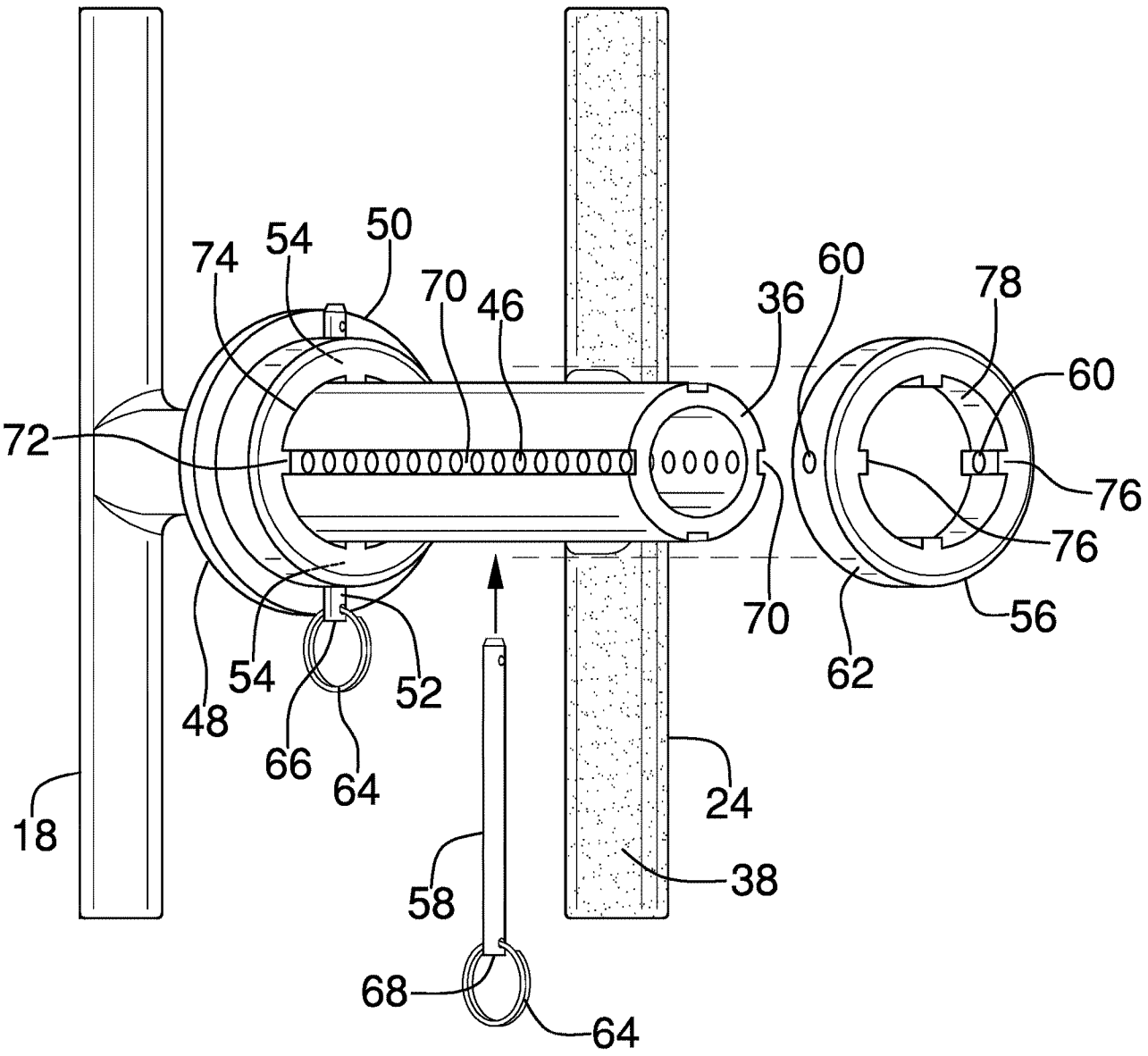
FIG. 10 is a top view of an embodiment of the disclosure.
Figure 11:
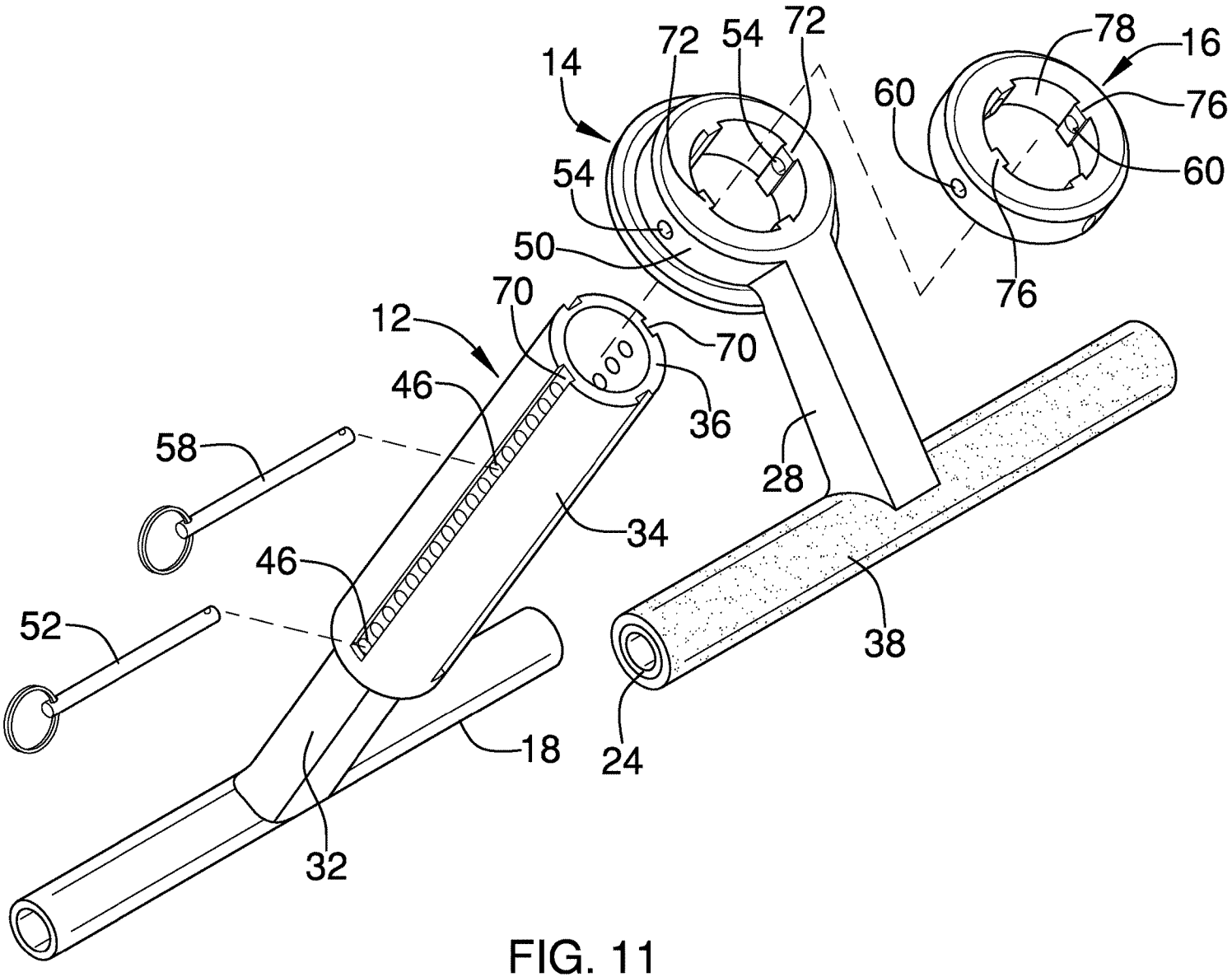
FIG. 11 is an exploded view of an embodiment of the disclosure.
Figure 12:
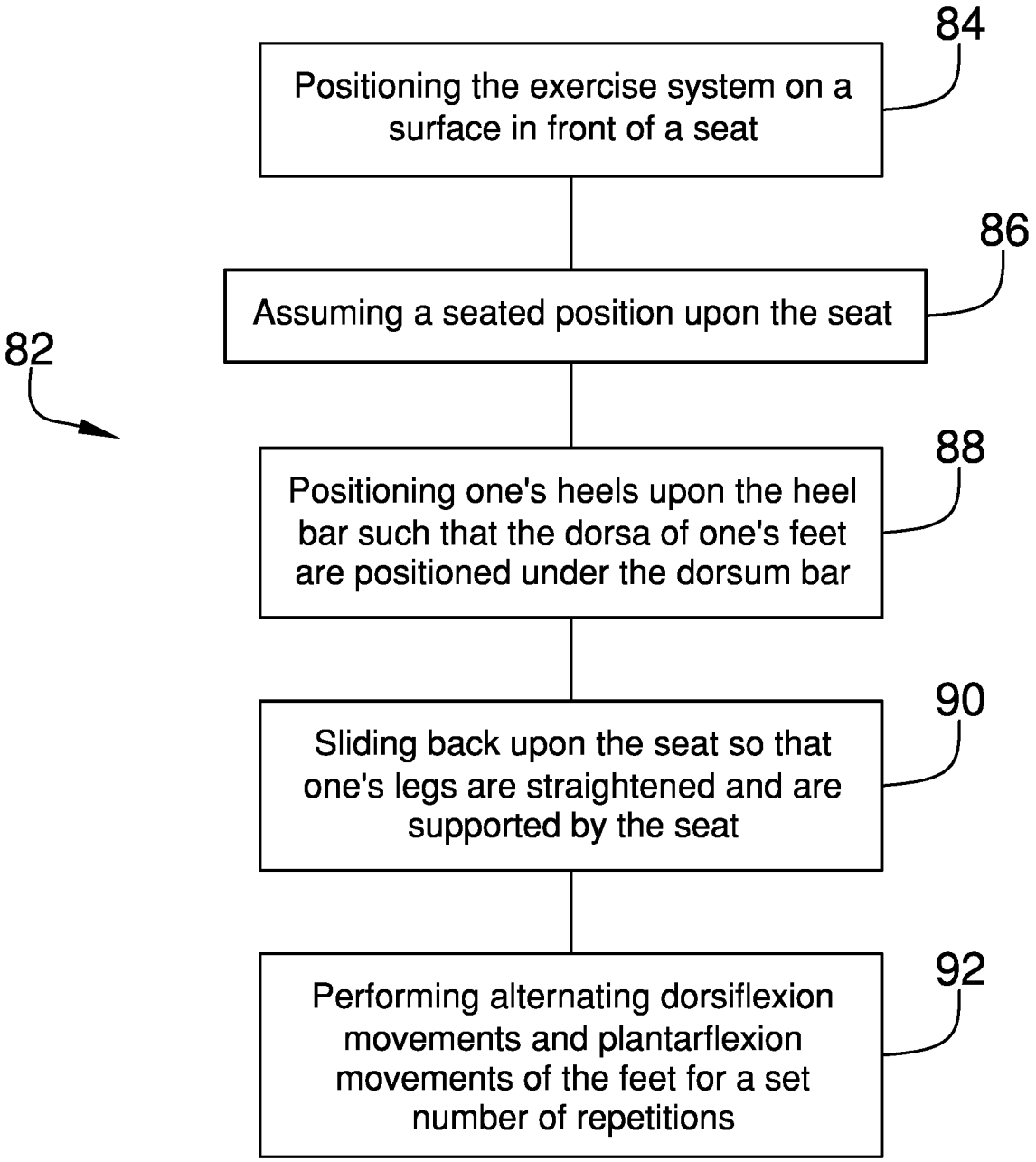
FIG. 12 is a flow diagram for a method utilizing an embodiment of the disclosure.

In this embodiment, as is shown in FIGS. 10 and 11, the locking element 16 comprises a lock ring 56, which is selectively positionable upon the weight bar 22 by insertion of the second end 36 of the weight bar 22 into the lock ring 56. A lock pin 58 is selectively insertable through a respective channel 46 and a pair of lock holes 60, the lock holes 60 of which are opposingly positioned on an outer circumference 62 of the lock ring 56, so that the locking element 16 is releasably secured to the weight bar 22 to retain the one or more weights 42 in position on the weight bar 22. It should be noted that the lock pin 58 could be effectively used to retain the one or more weights 42 in position without using the lock ring 56, as is shown in FIG. 6. The lock pin 58 and the set pin 52 may be of the same configuration, although the present invention also anticipates the lock pin 58 and the set pin 52 being of different configurations. For example, the lock pin 58 may be longer than the set pin 52 to increase its ability to stabilize the one or more weights 42. The locking element 16 may alternatively comprise what are known as locking collars often used for holding weights onto a barbell, for example, though for reasons stated below may not be as advantageous as the embodiment described herein.

Each pull ring 64 of a pair of pull rings 64 is hingedly attached proximate to an opposed end of a respective one of the set pin 52 and the lock pin 58 (66 and 68, respectively). The pull rings 64 allow a user to insert a finger and to pull on the set pin 52 and the lock pin 58 to extract them from the set ring 48 and the lock ring 56, respectively, and from the channels 46. The present invention anticipates other pulling elements in place of the pull rings 64, such as, but not limited to, fixed rings, crossbars, or the like. Prior art collars typically used to retain one or more weights 42 on a weight bar 22 are subject to movement and sliding while in use, whereas the set ring 48—set pin 52 and lock ring 56—lock pin 58 combinations prevent both movement and sliding, which is much safer for the user.

Other configurations which render the sliding element 14 slidable relative to the weight bar 22 are anticipated by the present invention. For example, the weight bar 22 may have a T shaped channel extending thereinto from its second end 36 and the extension bar 28 may have a complementary T-shaped protrusion extending from its second terminus 30. The T-shaped protrusion then could be slid into the T-shaped channel to a desired position and the sliding element 14 releasably secured to the weight bar 22 by insertion of a lock pin 58.

The second section 34 of the weight bar 22 has a pair of grooves 70 positioned therein and extending from the second end 36 to the first section 32 of the weight bar 22. Each channel 46 extends between the grooves 70 of the pair of grooves 70. A pair of set nubs 72 is attached to the set ring 48, with the set nubs 72 extending inwardly from an inner perimeter 74 of the set ring 48. Each set hole 54 extends through a respective set nub 72. Each set nub 72 is positioned in a respective groove 70 upon insertion of the weight bar 22 into the set ring 48. The set nubs 72 prevent rotation of the set ring 48 around the weight bar 22 to simplify alignment of the set holes 54 with a respective channel 46.

Similarly, a pair of lock nubs 76 is attached to the lock ring 56, with the lock nubs 76 extending inwardly from an inner circumference 78 of the lock ring 56. Each lock hole 60 extends through a respective lock nub 76. Each lock nub 76 is positioned in a respective groove 70 upon insertion of the weight bar 22 into the lock ring 56. The lock nubs 76 prevent rotation of the lock ring 56 around the weight bar 22 to simplify alignment of the lock holes 60 with a respective channel 46.

The plurality of channels 46 may be positioned in the weight bar 22 such that each channel 46 is perpendicular to the dorsum bar 18, as is shown in FIG. 1, or such that each channel 46 is parallel to the dorsum bar 18, as is shown in FIG. 2. The present invention also anticipates two pluralities of channels 46, one being perpendicular and the other being parallel to the dorsum bar 18, respectively, and the lock ring 56 having two pairs of lock holes 60 positioned therein, thereby allowing multiple options for attachment of the lock ring 56. Similarly, the weight bar 22 could have two pairs of grooves 70 positioned therein, with one plurality of channels 46 being positioned in one pair of grooves 70 and the other plurality of channels 46 being positioned in the other pair of grooves 70. The pluralities of channels 46 could be offset relative to one another within the pairs of grooves 70 so that an optimal channel 46 is accessible for use in securing the lock ring 46. Additionally, the set ring 48 could be fitted with two pairs of set nubs 72 and the lock ring 56 fitted with two pairs of lock nubs 76.

Figure 9:
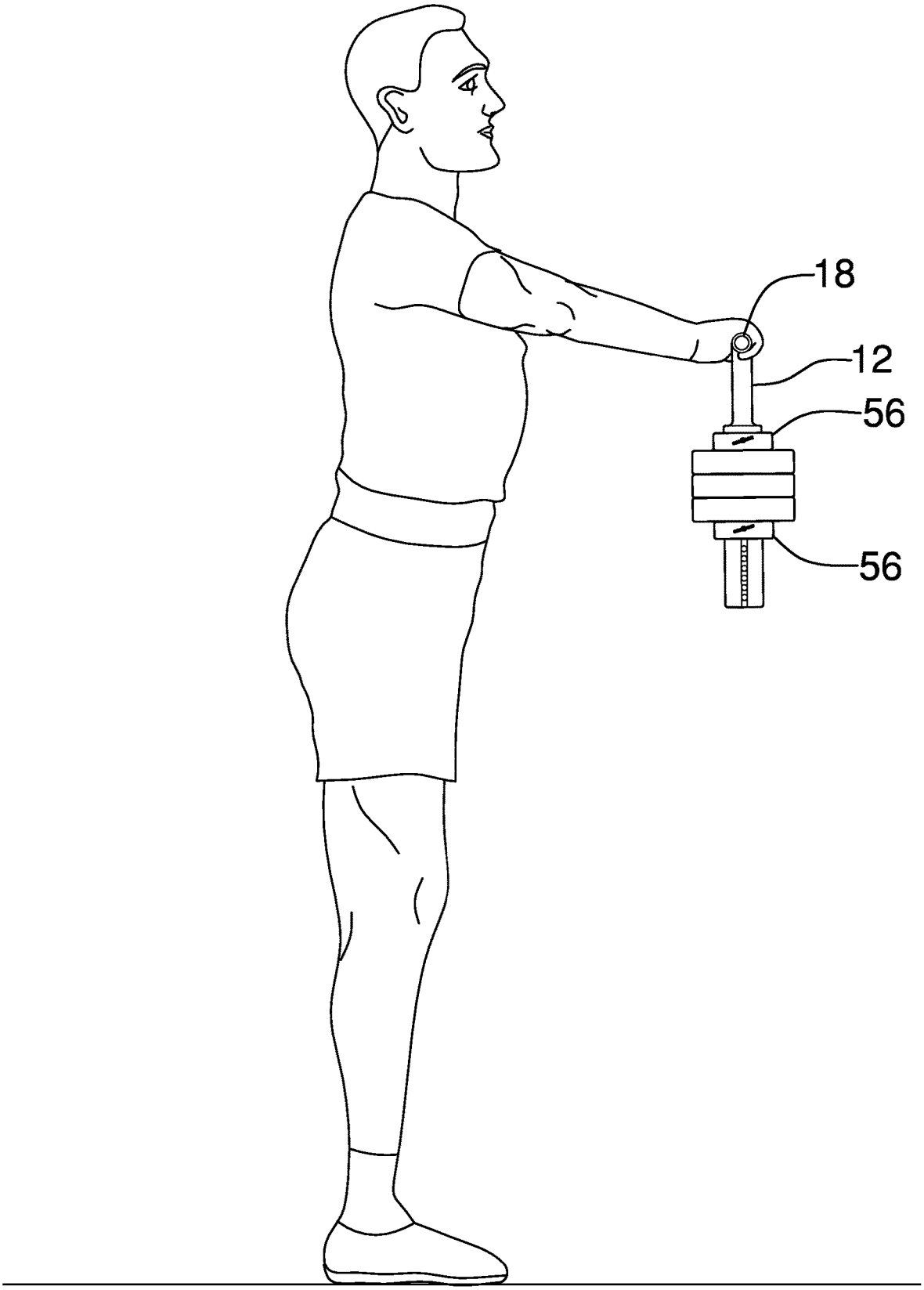
FIG. 9 is an in-use view of an embodiment of the disclosure.

The present invention also anticipates the lock ring 56 being one of a pair of lock rings 56, which would allow the one or more weights 42 to be positioned anywhere along the weight bar 22. Shifting of the one or more weights 42 proximate to the second end 36 of the weight bar 22 would effectively increase the resistance of the one or more weights 42 relative to the one or more weights 42 being positioned proximate to the set ring 48. Additionally, the pair of lock rings 56 would allow the one or more weights 42 to be releasably secured to the weight bar 22 without use of the sliding element 14, thereby enabling use of the exercise device 10 for arm exercises, such as, but not limited to, arm curls, wrist curls, or the like. One such exercise is depicted in FIG. 9. Alternatively, a prior art collar could be used on the weight bar 22, above the one or more weights 42, as the prior art collar would not be load-bearing. The lock ring 56 would be releasably secured below the one or more weights 42 to support their mass.

The present invention also includes an exercise system 80 targeting anterior tibialis muscles, which comprises the exercise device 10, as per the specification above and as shown in FIG. 6. The second terminus 30 of the extension bar 28 has been slid along the weight bar 22 to position the dorsum bar 18 and the heel bar 24 to fit feet of a user and the extension bar 28 has been releasably secured to the weight bar 22. The weight bar 22 has been inserted through the central hole 40 of one or more weights 42 so that the one or more weights 42 abut the extension bar 28. The locking element 16 has been slid along the weight bar 22 to abut the one or more weights 42 and has been releasably secured to the weight bar 22 to retain the one or more weights 42 in position on the weight bar 22. The user, upon being seated, can position their heels upon the heel bar 24 and the dorsa of their feet under the dorsum bar 18. The user then can slide back on the seat 44 so that their legs are straightened and supported and enable the user to perform alternating dorsiflexion movements and plantarflexion movements of the feet to exercise their anterior tibialis muscles.

Figure 8:
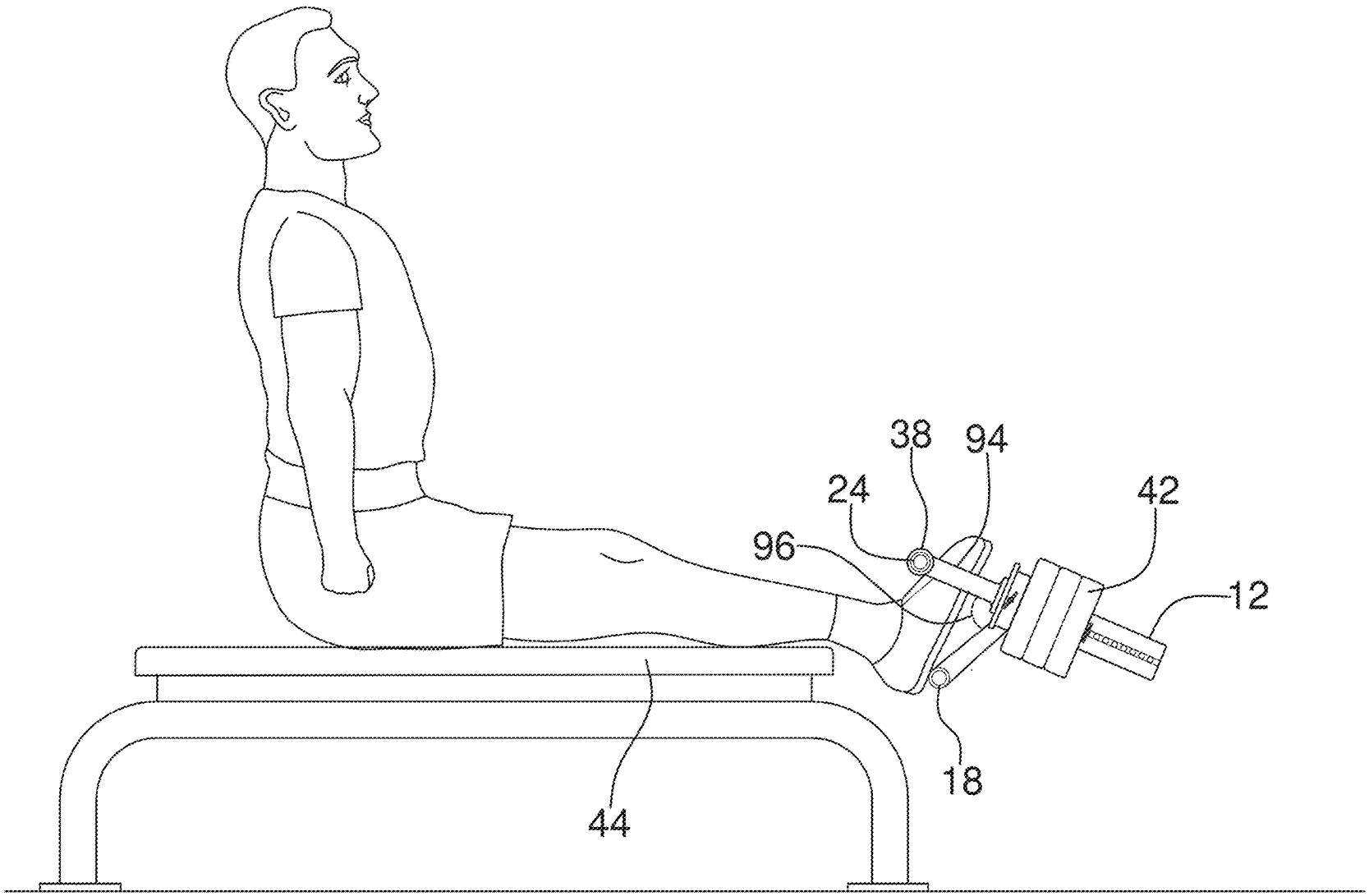
FIG. 8 is an in-use view of an embodiment of the disclosure.

In use, the exercise system 80 enables a method of exercising anterior tibialis muscles 82, which comprises providing the exercise system 80, as is described above. A first step 84 of the method 82 is positioning the exercise system 80 on a surface in front of a seat 44 so that the heel bar 24 and the one or more weights 42 of the exercise system 80 rest upon the surface with the first end 20 and the second end 36 of the weight bar 22 being positioned proximate to and distal from the seat, respectively. A second step 86 of the method 82 is assuming a seated position upon the seat 44. A third step 88 of the method 82 is positioning one's heels upon the heel bar 24 such that the dorsa of one's feet are positioned under the dorsum bar 18. A fourth step 90 of the method 82 is sliding back upon the seat 44 so that one's legs are straightened and are supported by the seat 44. A fifth step 92 of the method 82 is performing alternating dorsiflexion movements and plantarflexion movements of the feet, as is shown in FIG. 8.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An exercise device targeting anterior tibialis muscles comprising:

a weight engagement element comprising a dorsum bar being attached to and extending bidirectionally from a first end of a weight bar;

a sliding element comprising a heel bar and an extension bar, the heel bar being attached to and extending bidirectionally from a first terminus of the extension bar, a second terminus of the extension bar being slidable along and releasably securable to the weight bar at a selectable position such that the extension bar extends away from the weight bar, wherein the dorsum bar and the heel bar are positioned to fit feet of a user;

a locking element being configured to retain one or more weights on the weight bar, said locking element being slidable along and releasably securable to the weight bar, wherein the weight bar is configured for insertion through a central hole of the one or more weights such that the one or more weights abut the extension bar, wherein the exercise device is configured such that the user then can slide back on a seat so that the legs of the user are straightened and supported and enable the user to perform alternating dorsiflexion movements and plantarflexion movements of the feet to exercise their anterior tibialis muscles;

wherein the weight bar comprises:

a first section extending from the first end, the first section being substantially rectangularly box shaped; and a second section extending from a second end of the weight bar, the second section and the dorsum bar being cylindrical;

the weight bar having a plurality of channels extending axially therethrough;

the sliding element further comprising:

a set ring being selectively positionable upon the weight bar by insertion of the second end of the weight bar into the set ring, the extension bar being attached to and extending perpendicularly or angularly from an outer perimeter of the set ring; and a set pin being selectively insertable through a respective channel of the plurality of channels and a pair of set holes opposingly positioned on the outer perimeter of the set ring, such that the sliding element is releasably secured to the weight engagement element;

the locking element comprising:

a lock ring, the lock ring being selectively positionable upon the weight bar by insertion of the second end of the weight bar into the lock ring; and a lock pin being selectively insertable through a respective channel of the plurality of channels and a pair of lock holes opposingly positioned on an outer circumference of the lock ring, such that the locking element is releasably secured to the weight bar to retain the one or more weights in position on the weight bar;

the second section of the weight bar having a pair of grooves positioned therein and extending from the second end of the weight bar to the first section of the weight bar, each channel of the plurality of channels extending between the grooves of the pair of grooves;

the set ring having a pair of set nubs attached to and extending inwardly from an inner perimeter of the set ring, each set hole of the pair of set holes extending through a respective set nub of the pair of set nubs, such that each set nub of the pair of set nubs is positioned in a respective groove of the pair of grooves upon insertion of the weight bar into the set ring, such that the pair of set nubs prevents rotation of the set ring around the weight bar to simplify alignment of the pair of set holes with a respective channel of the plurality of channels; and the lock ring having a pair of lock nubs attached to and extending inwardly from an inner circumference of the lock ring, each lock hole of the pair of lock holes extending through a respective lock nub of the pair of lock nubs, such that each lock nub of the pair of lock nubs is positioned in a respective groove of the pair of grooves upon insertion of the weight bar into the lock ring, such that the pair of lock nubs prevents rotation of the lock ring around the weight bar to simplify alignment of the pair of lock holes with a respective channel of the plurality of channels.

2. An exercise system targeting anterior tibialis muscles comprising the exercise device of claim 1, wherein:

the second terminus of the extension bar has been slid along the weight bar to position the dorsum bar and the heel bar to fit feet of the user and the extension bar has been releasably secured to the weight bar;

the weight bar has been inserted through the central hole of the one or more weights, such that the one or more weights abut the extension bar; and the locking element has been slid along the weight bar to abut the one or more weights and has been releasably secured to the weight bar to retain the one or more weights in position on the weight bar; and wherein the exercise device is configured such that the user can slide back on the seat so that their legs are straightened and supported, enabling the user to perform alternating dorsiflexion movements and plantarflexion movements of the feet to exercise their anterior tibialis muscles.

3. A method of exercising anterior tibialis muscles using the exercise system of claim 2, the method comprising:

positioning the exercise system on a surface in front of the seat, such that the heel bar and the one or more weights of the exercise system rest upon the surface with the first end and the second end of the weight bar being positioned proximate to and distal from the seat, respectively;

assuming a seated position upon the seat;

positioning one's heels upon the heel bar such that the dorsa of one's feet are positioned under the dorsum bar;

sliding back upon the seat so that one's legs are straightened and are supported by the seat; and performing alternating dorsiflexion movements and plantarflexion movements of the feet.

4. The exercise device of claim 1, wherein an angle is formed between the extension bar and a portion of the weight bar from the sliding element to the first end, the angle having a measurement from 45° to 105°.

5. The exercise device of claim 1, wherein the heel bar is cylindrical.

6. The exercise device of claim 1, further including a padding comprised of a resiliently compressible material being positioned on the dorsum bar.

* * * * *